US006241566B1

(12) United States Patent
Kermis et al.

(10) Patent No.: US 6,241,566 B1
(45) Date of Patent: Jun. 5, 2001

(54) COOLER FOR MARINE STERN DRIVE

(76) Inventors: Paul C. Kermis, 137 Pacer Dr., Henrietta, County of Monroe, NY (US) 14467; Fred Doerscheln, 2755 County Rd. 37, Bloomfield, County of Ontario, NY (US) 14469

( * ) Notice: Subject to any disclaimer, the term of this patent is extended or adjusted under 35 U.S.C. 154(b) by 0 days.

(21) Appl. No.: 09/422,765

(22) Filed: Oct. 22, 1999

(51) Int. Cl.[7] ..... B63H 20/32
(52) U.S. Cl. ..... 440/76; 440/113
(58) Field of Search ..... 440/76, 88, 900; 165/44

(56) References Cited

U.S. PATENT DOCUMENTS 3,240,181 * 3/1966 Chandler et al. ..... 440/76
4,075,969 * 2/1978 Griffen ..... 440/88
4,371,351 * 2/1983 Tousey ..... 440/88
4,767,366 * 8/1988 Lang ..... 440/76
5,340,345 * 8/1994 Brodbeck et al. ..... 440/88
5,871,380 * 2/1999 Claussen ..... 440/88

* cited by examiner

*Primary Examiner*—Ed Swinehart
(74) *Attorney, Agent, or Firm*—Hoffman Stone

(57) ABSTRACT

Cooling apparatus for the stern drive unit of a marine inboard-outboard drive system, the cooling apparatus being of the kind making use of the ram effect and having an intake tube carried on the stern drive unit with its intake end in the water. The tube has an intake port held below the water surface for accepting water by the ram effect while the boat is moving forward. The water is carried by the tube to a system for delivering water from the intake tube to the stern drive unit for cooling it. According to the invention the bottom of the intake tube is closed and the intake port is formed closely adjacent to the bottom of the tube in a selected part of its wall facing forwardly when the boat is in forward motion.

3 Claims, 1 Drawing Sheet

COOLER FOR MARINE STERN DRIVE

This invention pertains to an improvement in the design of the intake port in cooling apparatus for a marine stern drive.

BACKGROUND OF THE INVENTION

Devices for cooling the outboard portions of inboard-outboard marine power drive systems, commonly called I-O, stern drive, or outdrive systems are well known. See, for example, U.S. Pat. No. 4,371,351 issued Feb. 1, 1983 to Gordon Tousey, which describes problems often encountered with these units due to overheating of gears and lubricants. Thermal cycling of the housing also creates problems. The patent also describes apparatus for cooling the outboard systems by using the ram effect to scoop water from the supporting medium, conduct it up and spray it over the stern drive unit.

Cooling systems of this kind have been found to be effective in reducing the operating temperatures of the stern drive units, and thereby significantly reducing the failure rate and improving durability. The effectiveness of the systems is especially beneficial in high performance and racing boats, and is also advantageous in units that operate under less severe stress.

In modern installations of this kind the cooling systems are mounted on the stern drive units, avoiding the distaste most boat owners have toward mounting the systems on the transoms of their boats, simplifying the installation, and generally making for a neat and unobtrusive appearance. Vertical holes are drilled in the anti-cavitation plates of the stern drive, one hole for each of the water intake tubes in the cooling system, the holes being sized to fit the tube, or tubes closely. The tube, or tubes are then inserted through the holes from above, extending about three inches or so below the plates and into the propeller stream.

The tubes are open ended, cut at about a 450 angle and positioned with their open, oval faces directed forwardly.

The opposite, upper end of the tube, or tubes is then secured, usually by a single fastener, to the body of the drive unit near its top. Outlet openings, called dump ports, are cut in the intake tube at strategic points along its length to direct water toward and upon the body of the unit.

This is the arrangement of concern here. A problem presents itself especially in so-called high performance and racing boats when they are operated at high stress and their drivers are trying to maximize speed. Under these conditions the cooling systems often fail to deliver the expected cooling water; at times when maximum cooling is desired and needed the systems reduce their efficacy and often fail to deliver any water at all.

SUMMARY OF THE INVENTION

According to the invention it has now been found that this effect, a decrease in the flow of cooling water when an increase is needed, can be reversed by suitably shaping the intake port of the cooling apparatus. Instead of leaving the intake tube open ended with its 45° face pointing downwardly, the end of the tube is closed and the intake port is formed as a simple opening of any desired shape in the forward facing part of the tube wall so the intake port faces directly forward.

The arrangement of the invention, at least at the present time, entails slightly greater manufacturing cost than the traditional arrangement with open ended intake tubes, but the improvement in operation is notable, and well worth the small added expense. Instead of losing effectiveness as speed and power increase, the flow of cooling water increases as the need increases.

BRIEF DESCRIPTION OF THE DRAWINGS

A presently preferred embodiment of the invention will now be described in conjunction with the drawing, wherein.

DETAILED DESCRIPTION OF THE INVENTION

Figure 1:
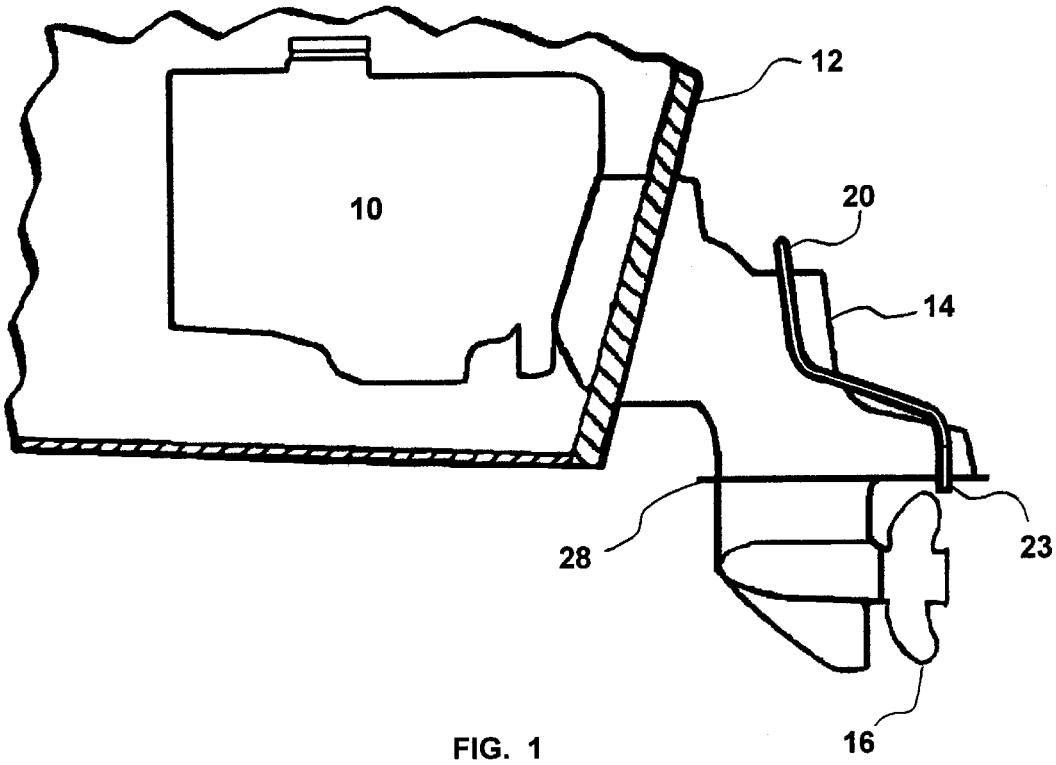
FIG. 1 is a side elevational view, partly in section, of the aft portion of a boat having an inboard engine with a stem drive unit mounted on the transom and fitted with a cooling apparatus according to the prior art.

Referring now particularly to FIG. 1, a typical marine I-O power system includes an engine 10 mounted within the boat hull at the rear adjacent to the transom 12. A drive shaft (not shown) extends from the engine through the transom into the stem drive 14 for driving the propeller 16.

Figure 2:
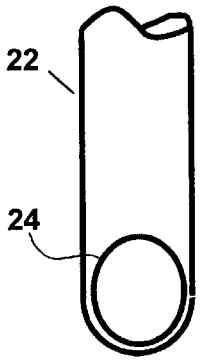
FIG. 2 is an enlarged fragmentary side elevational view of the lower end of an intake tube for a stern drive cooling apparatus according to the usual construction of the prior art.

In operation, as explained hereinabove, the mechanism within the stern drive tends to become overheated at times, and the stern drive is shown as equipped with a cooling apparatus generally designated 20 for delivering cooling water to its housing. The cooling apparatus comprises a pickup tube 22 having an intake port 24 near its bottom, and usually a spray head, dump ports 26, or some alternative system in its upper portion for delivering water to the stern drive. The pickup tube extends through and about one-half to three inches below the anti-cavitation plate 28, which is an integral part of the stem drive housing. The pickup tube 22, as shown in FIG. 2, has always been open ended, being cut at about 45° forming the intake port 24 as an oval facing forwardly of the boat.

This arrangement gives satisfactory results in most situations, but at times when the stern drive is tilted toward the rear (with its lower end farther aft than its upper end) it frequently fails and stops delivering cooling water. Unfortunately, tilting toward the rear is commonly commanded by the driver of the boat when he is already moving at a fast speed and simply wants to maximize his speed, thereby placing the stem drive under maximum stress. The stern drive is usually tilted toward the rear in the most stressful situations, when it is most likely to overheat.

It has now been found that this problem can be avoided very simply, and the flow of water can be made to increase as the boat speed increases regardless of the degree or direction of the tilt of the stern drive.

Figure 3:
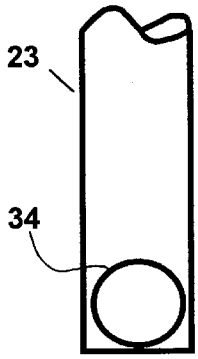
FIG. 3 is enlarged fragmentary side elevational view of the lower end of an intake tube for a stern drive cooling apparatus according to the presently preferred embodiment of the invention.

In accordance with the invention, as shown in FIG. 3, the pickup tube 23 is closed at its lower end and the intake port 34 is formed as a window in the forwardly facing part of the tube wall. It has been found that with the intake port thus formed the performance of the cooling apparatus is greatly improved. The flow of cooling water does not taper off nor does it stop altogether when the stern drive is tilted to the rear. Instead, the flow is maintained so long as the speed of the boat is maintained, and regardless of the tilt of the drive unit the flow of water increases as the speed of the boat increases.

The intake tube 23 may be made of any desired material suitable for marine use, such as, for example, one of the stainless steel alloys in the 300 series. It is typically about one-half inch in inside diameter, and of fairly heavy wall of about, say, one thirty-second inch thickness. In all respects save for its closed end and the direction that the intake port faces it may be similar to the intake tubes of the prior art.

What is claimed is:

1. Cooling apparatus for the stem drive unit of a marine inboard-outboard power system comprising a pickup tube having a lower portion and an upper portion, the bottom of the lower portion of the tube being closed, the lower portion having a forwardly facing opening in its wall closely adjacent to its bottom and positioned to serve as an intake port to admit water into the tube by the ram effect when the apparatus is mounted on the drive unit and in use on a boat travelling in its forward direction.

2. Cooling apparatus for the stem drive unit of a marine inboard-outboard power system comprising a pickup tube having lower and upper portions, the bottom of the lower portion of the tube being closed, the lower portion having a forwardly facing opening in its wall closely adjacent to its bottom and positioned to serve as an intake port to admit water into the tube by the ram effect when the apparatus is mounted on the drive unit and in use on a boat travelling in its forward direction, and said upper portion having dump ports positioned to face the drive unit for delivering cooling water from the pickup tube to the stem drive unit when in use.

3. Cooling apparatus for a stem drive unit of a marine inboard-outboard power system of the kind having a generally horizontal anti-cavitation plate positioned closely above its water screw, said apparatus comprising a pickup tube having an upper portion and a lower portion, the bottom end of the lower portion being closed, the lower portion having a directly forwardly facing opening sized to serve as an intake port near its bottom and positioned below the anti-cavitation plate when the apparatus is mounted on the stern drive, the upper portion having dump ports arranged to deliver water received from the lower portion to the outer surface of the stern drive.

* * * * *